United States Patent [19]

Harrell

[11] Patent Number: 4,536,975

[45] Date of Patent: Aug. 27, 1985

[54] MULTI-PURPOSE DETACHABLE POCKET SYSTEM

[76] Inventor: Bruce W. Harrell, 3402 Auchentoroly Ter., Baltimore, Md. 21217

[21] Appl. No.: 595,415

[22] Filed: Mar. 30, 1984

Related U.S. Application Data

[63] Continuation-in-part of Ser. No. 504,888, Jun. 16, 1983, Pat. No. 4,507,882.

[51] Int. Cl.[3] ..... A43B 23/24

[52] U.S. Cl. ..... 36/136; 2/245; 40/2 E

[58] Field of Search ..... 36/136, 132, 100, 114, 36/50; 24/117; 2/245, 247; 40/2 E

[56] References Cited

U.S. PATENT DOCUMENTS

| | | | |
|---|---|---|---|
| 776,767 | 12/1904 | Waters | 36/136 X |
| 1,952,409 | 3/1934 | Berg | 36/136 X |
| 2,662,677 | 12/1953 | Perry | 36/136 X |
| 2,801,477 | 8/1957 | Adams et al. | 36/100 X |
| 3,822,489 | 7/1974 | Johnson | 36/100 |
| 4,428,101 | 1/1984 | Harkavy | 24/117 |

*Primary Examiner*—Werner H. Schroeder
*Assistant Examiner*—T. G. Graveline
*Attorney, Agent, or Firm*—John F. McClellan, Sr.

[57] ABSTRACT

An improved detachable pocket assembly for carrying I.D. cards, photos, coins, keys, tickets and the like on apparel such as shoes includes a pocket formed between front and back faces of sheet material, one of which faces preferably has a transparent plastic window sealed over an opening in it. The pocket can be pivoted in order for the wearer to look into it when wearing it on a shoe. The pocket has at the upper end an opening for access to contents, covered by a first extension at the top of the front face, folds over in a rearward and downward direction for rain shedding and has provision for securing the pocket to apparel, in the form of a strap-like extension from the bottom of the pocket that wraps around the pocket and detachably secures by snaps intermediate the back of the pocket and on the front of the pocket. These snaps or equivalent fasteners provide a securance for holding closed the fold over extension closed, and a backup securance for holding it positively to a shoe when the pocket is open and being pivoted, pushed or pulled for manipulating the contents; keyring can be carried by the detached pocket assembly.

7 Claims, 11 Drawing Figures

MULTI-PURPOSE DETACHABLE POCKET SYSTEM

This application is a continuation in part of my co-pending application Ser. No. 504,888, filed on 6-16-83 for DETACHABLE SHOE POCKET SYSTEM now U.S. Pat. No. 4,507,882.

FIELD OF THE INVENTION

This invention relates generally to apparel and particularly to an improved detachable pocket system for use with shoes, belts and other apparel as desired.

BACKGROUND OF THE INVENTION

My co-pending application discloses a quick-attach, quick-detach shoe accessory in the form of a container for carrying keys, rings, paper money, coins and the like items on the instep of a tennis shoe or other lace type shoe, has a sheath-like body with open top end with a covering flap and closed bottom and pleated sides securable to a shoe by a tongue attached to the bottom, passing beneath the shoe laced portion and terminating at the top in an end having a pair of shoe-lace holes matching another pair of shoe-lace holes in an upward extension of the body so that shoe laces may be passed through the shoelace holes and tied, holding the container on the top of the instep of the user's foot.

SUMMARY OF THE INVENTION

Principal objects of the present invention are to provide a device of the character described, with improved access, in simple-to-make embodiments that require little material, and are reliable and convenient for "walking" storage of I.D. cards, photos, coins, bills, checks, drivers' licenses, small memo pads and books, keys, rings and a variety of other small objects.

Further important objects are to provide a device of the character described that is very quick and easy to put on and take off, that is versatile and not constrained to use with a lace-type shoe but can be used with strap-type shoes as well, and that sheds rain and splashed water exceptionally well.

Still further objects are to provide such a device, that can secure to a shoe, a belt, a wristlet or bracelet or the like with a backup provision while the pocket is being opened or closed, and that in an embodiment provides a window for viewing photos, passes or the like without need to open the pocket.

Yet further objects are to provide such a device, that can detachably secure a keyring to the user's belt in a choice of hanging positions, and that can in one size substantially fit all.

The invention, in more detail, provides an improved detachable pocket assembly for carrying I.D. cards, photos, coins, keys, tickets and the like on apparel such as shoes includes a pocket formed between front and back faces of sheet material, one of which faces preferably has a transparent plastic window sealed over an opening in it. The pocket can be pivoted in order for the wearer to look into it when wearing it on a shoe. The pocket has at the upper end an opening for access to contents, covered by a first extension at the top of the front face, folds over in rearward and downward direction for rain shedding, and has provision for securing the pocket to apparel, in the form of a strap-like extension from the bottom of the pocket that wraps around the pocket and detachably secures by snaps intermediate the back of the pocket and on the front of the pocket. These snaps or equivalent fasteners provide a securance for holding closed the fold-over extension, and a backup securance for holding it positively to a shoe when the pocket is open and being pivoted, pushed or pulled for manipulating the contents; a keyring can be carried by the detachable pocket assembly.

BRIEF DESCRIPTION OF THE DRAWINGS

The above and other objects and advantages of the invention will become more readily apparent on examination of the following description, including the drawings in which like reference numerals refer to like parts.

DETAILED DESCRIPTION

Figure 1:
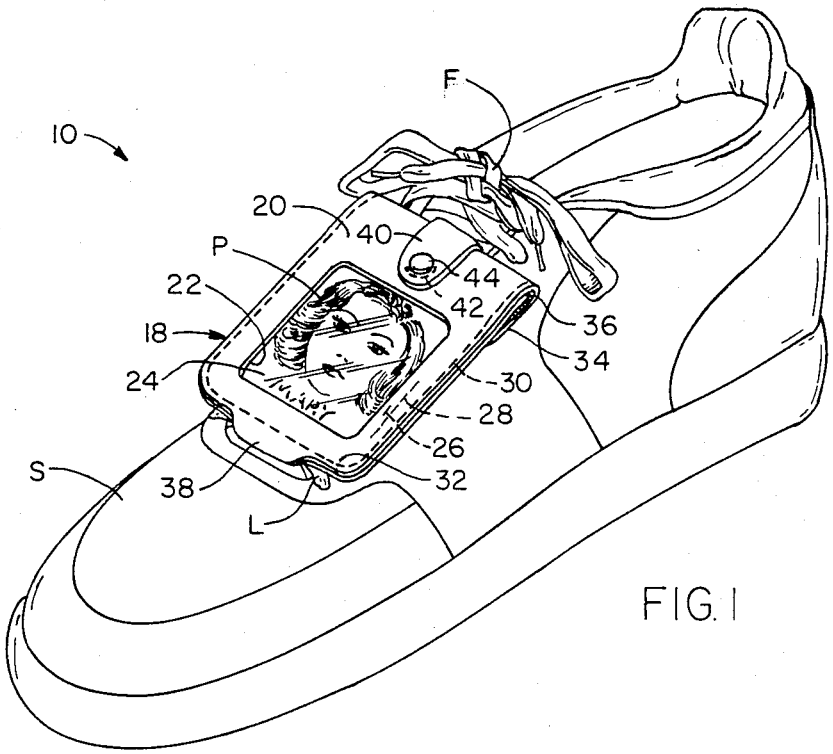
FIG. 1 is a perspective view of a preferred embodiment of the invention in use with a typical shoe and with the pocket of the invention in closed, secured, mode.

FIG. 1 shows the first embodiment 10 of the detachable pocket assembly of this invention atached to a typical shoe S, in this case a lace type athletic shoe.

The detachable pocket assembly 10 includes on pocket 18 a front or face portion 20 with a rectangular cut-out 22 over which a transparent plastic window 24 is sealed inside as by cement 26 around the margin 28. A photo P for identification or for sentimental reasons or other item can readily be displayed while protected by the window and held inside the pocket between front face 20 and backface 30 that may be sealed together as by stitches 32 around the bottom and sides. Securing against loss, dust and water is a first or upward extension 34 of the front face, that folds toward the back around the open top 36 of the pocket and then downward, where it is held shut in this water-shedding position.

Securing the pocket assembly 10 to the shoe S is a second or downward extension 38 of the front face. From the bottom edge this curves around and passes beneath the laces L of the shoe. If the shoe worn by the user has one or more Flexible straps, the second extension 38 can pass beneath one or more of them, as desired to locate it comfortably over the instep. In this application transverse straps and laces are equivalents. The second extension preferably emerges from beneath the laces short of the shoe fastening (knot F in the laces) so that the fastening can be released or otherwise adjusted without need to disturb the pocket assembly.

After emergence from beneath the laces, the free end 40 of the second extension 38 curls up and out around the closed first extension 34 and then down, where it detachably secures centrally above the window, on the front face. Male and female snaps 42, 44 may be used for this, or mating "Velcro" materials, similarly attached.

Figure 2:
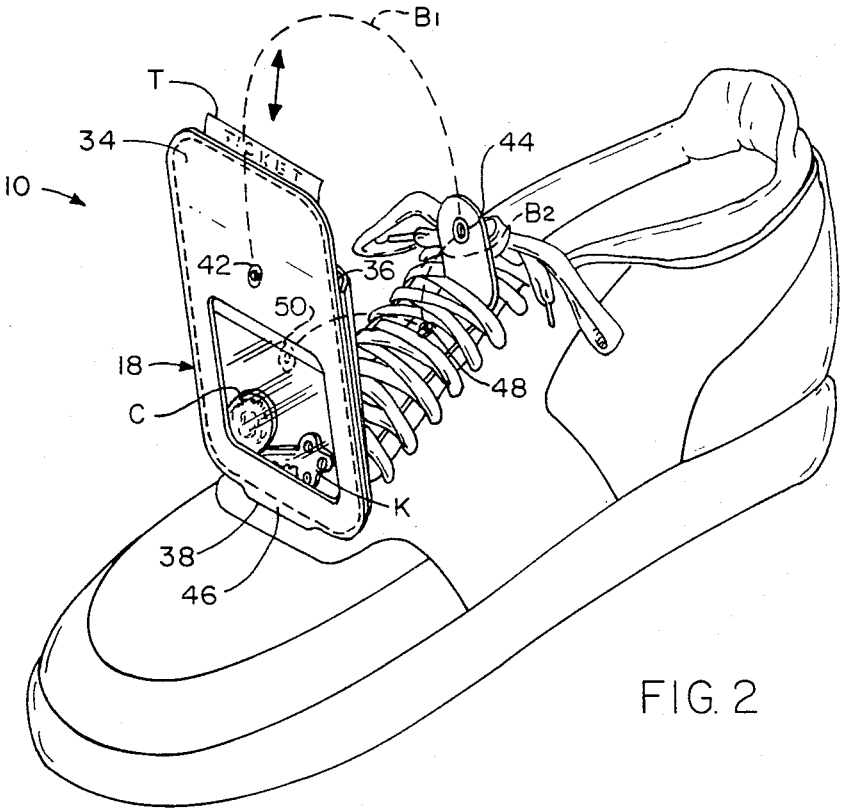
FIG. 2 is a perspective viw similar to FIG. 1 but with the pocket open for access.

FIG. 2 shows the embodiment 10 freed of attachment to the snaps 42, 44 on the free end of the second extension and pivoted to any upright position, about the attached end 46 of the second extension 38 which is the means permitting the pivoting. The user can conveniently look down into the pivoted pocket through open top 36 after unfolding the closure flap or first extension 34, and can look through the window by pivoting the pocket 18 as necessary. The opposed edges of the pocket can be squeezed to separate farther the front and back and hold the pocket 18 open.

Broken line $B_1$ indicates relation of the attachments 42 and 44 used to secure the pocket closed. Broken lines $B_2$ indicates the relation of a backup feature; the free end snap 44 or attachment can be pivoted to and secured to a mating snap 48 or closure member intermediate the length of the second extension on the back face.

This provides means for positively holding the pocket assembly 10 to the shoe (or other support) while the pocket 18 is open, and permits the user to tug on the pocket 18 while extracting or inserting (arrow) keys K, coins C, ticket T or whatever, without danger of pulling the pocket assembly wholly or partially free of the laces or other securance.

Snap or attachment 48 is normally secured to a mating attachment 50 on the back face of the pocket, for doubling security of the attachment of the pocket assembly to the shoe or other supporting article, in closed position.

Figure 3:
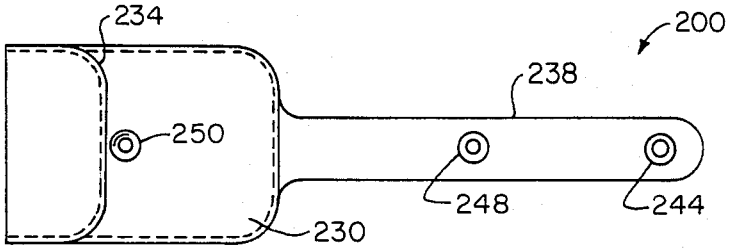
FIG. 3 is a back view of a second embodiment in extended mode.
Figure 4:
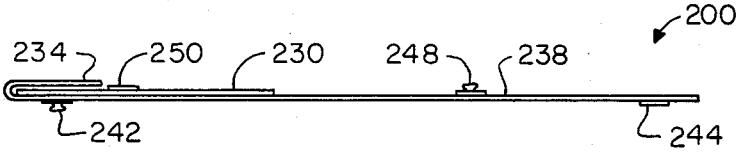
FIG. 4 is a side elevational view of the second embodiment in extended mode.
Figure 5:
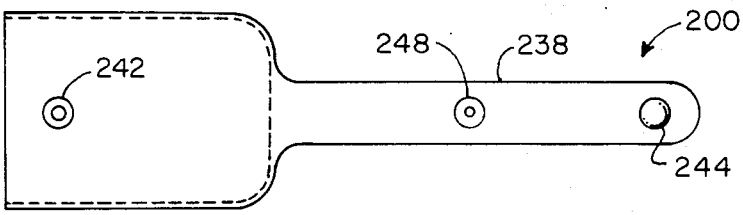
FIG. 5 is a face view of the second embodiment in extended mode.

FIGS. 3, 4 and 5 show the second embodiment 200 in extended position. The first embodiment is similar but has the window. First extension 234 of the face folds around and closes the access opening. Strap-like second extension 238, (it may be one-third the width of the pocket for economy and ease of use) folds around the back face 230 and secures by snap 248 to mating snap 250 on the back face, then continues and the free end wraps around the first extension or flap 234 and holds it closed by attachment of snap 244 to mating snap 242 on the front face below the flap.

The second extension could originate at the bottom or the back face if desired.

Figure 6:
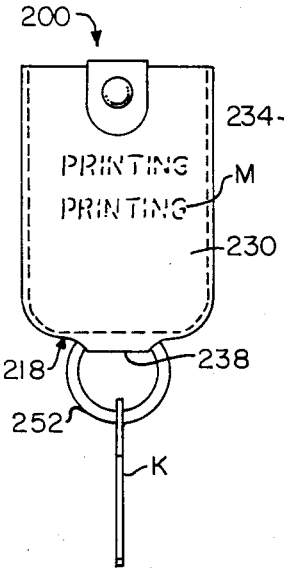
FIG. 6 is a face view of the second embodiment in closed mode; and detachably supporting a keyring.
Figure 7:
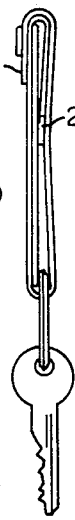
FIG. 7 is a side elevational view of the FIG. 6 showing.

FIGS. 6 and 7 show that a keyring 252 for supporting a key K or keys can be held in the loop formed by the second extension 238 as it curves upward adjacent the point of attachment of the pocket 218. The snap attachment, 248 indicated, of the second extension to the back face is means permitting opening the flap 234 without losing the keyring, or if supporting apparel such as a belt passes below the snap attachment indicated by 248, without detaching the pocket assembly from it, when opening the flap.

Advertising material can be printed on the front face 230 of the pocket.

Figure 8:
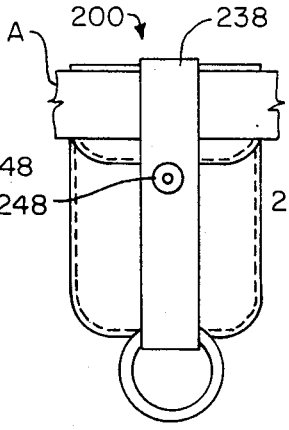
FIG. 8 is a back view of the second embodiment similar to the FIG. 6 showing but with a portion of a supporting strap or belt.

FIG. 8 shows that supportive apparel A such as a belt can be engaged at the upper end of the pocket assembly by the second extension 238 between snap attachment at 248 and the second extension free end snap attachment.

Figure 9:
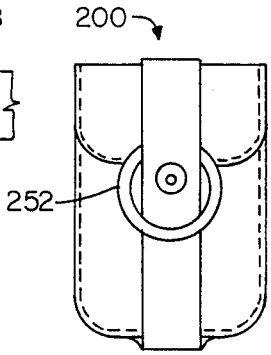
FIG. 9 is a back view of the second embodiment, similar to the FIG. 8 view but without the portion of supporting strap, and with the keyring in a higher-hanging location.

FIG. 9 shows that, like the belt, a keyring 252 can be supported near the top of the pocket assembly. Hanging at this location, keys are less free to rattle and less visible, but ready for instant detachment from the pocket assembly.

Figure 10:
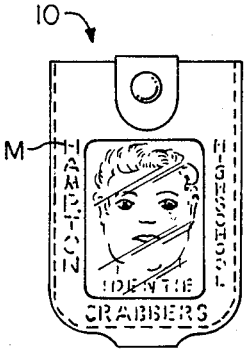
FIG. 10 is a face view of the first embodiment in closed mode.

FIG. 10 shows that in the first embodiment 10, advertising material M or school identification or other such material can be printed around the margins of the window.

Figure 11:
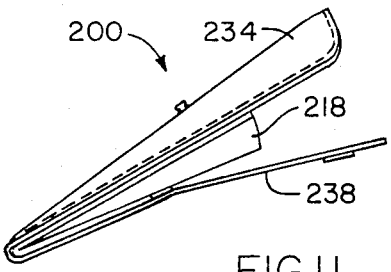
FIG. 11 is an edge view of the second embodiment in partially open mode.

FIG. 11 shows the second embodiment 200 in edge view with the pocket 218 opened, for which the end of the second extension 238 has been unsnapped and the first extension 234 has been unfolded.

Size can be:

overall length: $10\frac{1}{2}$ inches (26.6 cm)
width of pocket: $2\frac{1}{2}$ inches (6.2 cm)
length of pocket: $3\frac{1}{2}$ inches (8.5 cm)
window width: $1\frac{5}{8}$ inches (4.1 cm)
window length: $2\frac{1}{8}$ inches (5.2 cm)
length of first extension: $1\frac{1}{2}$ inches (3.7 cm)
distance from pocket to first attachment along second extension: $2\frac{5}{8}$ inches (6.3 cm)
distance from pocket to second attachment along second extension: $5\frac{1}{8}$ inches (13.5 cm)

In summary, the versatility and economy and safety backup features and general multiple usefulnesses of the invention will be apparent, and that one size will fit substantially all users. Material may be leather or thermoplastic.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a detachable pocket system for support by apparel such as laces of shoes or belts and having: a pocket with a bottom, open top, front face and back face and fold over cover for extending over the open top, a strap extending from the bottom of the pocket and having means for detachably securing around objects such as shoelaces or belts, the improvement comprising: the fold over cover being an extension of said front face and said extension over the open top being extend rearwardly and downwardly, said strap being an extension of one or the other of said front and back faces and extending rearwardly, then upwardly and then forwardly over said extension of the front face and downwardly to a free end, and said means for detachably securing including first means for attaching the free end to the front face.

2. In a system as recited in claim 1, a window in said front face.

3. In a system as recited in claim 1, backup securance comprising said means for detachably securing further including second means for attaching an intermediate portion of said strap to said back face.

4. In a system as recited in claim 3, said strap adapted for hanging a keyring in a choice of hanging positions.

5. In a system as recited in claim 3, said means for detachably securing including means permitting pivoting said pocket for looking down into said pocket when said system is supported by laces of a shoe.

6. In a system as recited in claim 5, and means for positively holding said system to said laces of a shoe when said pocket is pivoted.

7. In a system as recited in claim 6, said means for positively holding including a portion of said means for attaching the free end being located in position for engaging a portion of said means for attaching an intermediate portion of said strap, when the pocket is pivoted.

* * * * *